US007663046B2

(12) United States Patent
Kulkarni et al.

(10) Patent No.: US 7,663,046 B2
(45) Date of Patent: Feb. 16, 2010

(54) PIPELINE TECHNIQUES FOR PROCESSING MUSICAL INSTRUMENT DIGITAL INTERFACE (MIDI) FILES

(75) Inventors: Prajakt Kulkarni, San Diego, CA (US); Eddie L. T. Choy, Carlsbad, CA (US); Nidish Ramachandra Kamath, Placentia, CA (US); Samir K Gupta, San Diego, CA (US); Stephen Molloy, San Diego, CA (US); Suresh Devalapalli, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 10 days.

(21) Appl. No.: 12/042,170

(22) Filed: Mar. 4, 2008

(65) Prior Publication Data

US 2008/0229918 A1 Sep. 25, 2008

Related U.S. Application Data

(60) Provisional application No. 60/896,455, filed on Mar. 22, 2007.

(51) Int. Cl.
*G10H 1/00* (2006.01)

(52) U.S. Cl. ..... 84/600; 84/626; 84/645

(58) Field of Classification Search ..... 84/600–602, 84/645, 626, 662
See application file for complete search history.

(56) References Cited

U.S. PATENT DOCUMENTS 4,611,522 A * 9/1986 Hideo ..... 84/607
4,616,546 A * 10/1986 Uchiyama et al. ..... 84/659
4,966,053 A * 10/1990 Dornes ..... 84/718
5,056,402 A * 10/1991 Hikawa et al. ..... 84/645
5,117,726 A * 6/1992 Lisle et al. ..... 84/608
5,131,311 A * 7/1992 Murakami et al. ..... 434/307 A
5,747,714 A * 5/1998 Kniest et al. ..... 84/604
5,917,917 A * 6/1999 Jenkins et al. ..... 381/63
6,008,446 A * 12/1999 Van Buskirk et al. ..... 84/603
6,093,880 A * 7/2000 Arnalds ..... 84/464 R (Continued)

FOREIGN PATENT DOCUMENTS

WO 2005036396 4/2005

OTHER PUBLICATIONS

Roads: The Computer Music Tutorial, pp. 675-677, XP002485635, Jan. 1, 1996.

(Continued)

*Primary Examiner*—David S. Warren
(74) *Attorney, Agent, or Firm*—Espartaco Diaz Hidalgo

(57) ABSTRACT

This disclosure describes techniques for processing audio files that comply with the musical instrument digital interface (MIDI) format. In particular, various tasks associated with MIDI file processing are delegated between software operating on a general purpose processor, firmware associated with a digital signal processor (DSP), and dedicated hardware that is specifically designed for MIDI file processing. Alternatively, a multi-threaded DSP may be used instead of a general purpose processor and the DSP. In one aspect, this disclosure provides a method comprising parsing MIDI files and scheduling MIDI events associated with the MIDI files using a first process, processing the MIDI events using a second process to generate MIDI synthesis parameters, and generating audio samples using a hardware unit based on the synthesis parameters.

30 Claims, 4 Drawing Sheets

U.S. PATENT DOCUMENTS

| | | | | |
|---|---|---|---|---|
| 6,105,119 | A * | 8/2000 | Kerr et al. | 711/219 |
| 6,150,599 | A | 11/2000 | Fay et al. | |
| 6,570,081 | B1 * | 5/2003 | Suzuki et al. | 84/622 |
| 6,665,409 | B1 * | 12/2003 | Rao | 381/63 |
| 6,787,689 | B1 * | 9/2004 | Chen | 84/600 |
| 6,806,412 | B2 * | 10/2004 | Fay | 84/645 |
| 6,970,822 | B2 | 11/2005 | Fay et al. | |
| 7,005,572 | B2 * | 2/2006 | Fay | 84/645 |
| 7,065,380 | B2 * | 6/2006 | Adams | 455/550.1 |
| 7,232,949 | B2 * | 6/2007 | Hruska et al. | 84/610 |
| 7,363,095 | B2 * | 4/2008 | Hiipakka et al. | 700/94 |
| 7,414,187 | B2 * | 8/2008 | Park et al. | 84/645 |
| 7,427,709 | B2 * | 9/2008 | Lee et al. | 84/645 |
| 7,442,868 | B2 * | 10/2008 | Park et al. | 84/603 |
| 7,444,194 | B2 * | 10/2008 | Fay et al. | 700/94 |
| 7,462,773 | B2 * | 12/2008 | Park et al. | 84/607 |
| 2002/0103552 | A1 | 8/2002 | Boucher et al. | |
| 2002/0170415 | A1 * | 11/2002 | Hruska et al. | 84/609 |
| 2003/0084779 | A1 * | 5/2003 | Wieder | 84/609 |
| 2005/0091065 | A1 * | 4/2005 | Fay et al. | 704/278 |
| 2005/0185541 | A1 * | 8/2005 | Neuman | 369/47.19 |
| 2005/0204903 | A1 * | 9/2005 | Lee et al. | 84/645 |
| 2006/0086238 | A1 * | 4/2006 | Lee et al. | 84/645 |
| 2006/0086239 | A1 * | 4/2006 | Lee et al. | 84/645 |
| 2006/0129388 | A1 * | 6/2006 | Park et al. | 704/219 |
| 2008/0229918 | A1 * | 9/2008 | Kulkarni et al. | 84/645 |

OTHER PUBLICATIONS

International Search Report-PCT/US2008/057271, International Searching Authority-European Patent Office-Jul. 31, 2008.

Written Opinion-PCT/US2008/057271, International Searching Authority-European Patent Office-Jul. 31, 2008.

* cited by examiner

PIPELINE TECHNIQUES FOR PROCESSING MUSICAL INSTRUMENT DIGITAL INTERFACE (MIDI) FILES

RELATED APPLICATIONS

Claim of Priority Under 35 U.S.C. §119

The present Application for Patent claims priority to Provisional Application No. 60/896,455 entitled "PIPELINE TECHNIQUES FOR PROCESSING MUSICAL INSTRUMENT DIGITAL INTERFACE (MIDI) FILES" filed Mar. 22, 2007, and assigned to the assignee hereof and hereby expressly incorporated by reference herein.

TECHNICAL FIELD

This disclosure relates to audio devices and, more particularly, to audio devices that generate audio output based on musical instrument digital interface (MIDI) files.

BACKGROUND

Musical Instrument Digital Interface (MIDI) is a format used in the creation, communication and/or playback of audio sounds, such as music, speech, tones, alerts, and the like. A device that supports the MIDI format playback may store sets of audio information that can be used to create various "voices." Each voice may correspond to one or more sounds, such as a musical note by a particular instrument. For example, a first voice may correspond to a middle C as played by a piano, a second voice may correspond to a middle C as played by a trombone, a third voice may correspond to a D# as played by a trombone, and so on. In order to replicate the musical note as played by a particular instrument, a MIDI compliant device may include a set of information for voices that specify various audio characteristics, such as the behavior of a low-frequency oscillator, effects such as vibrato, and a number of other audio characteristics that can affect the perception of sound. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be coded in accordance with the MIDI format by specifying events that indicate when certain voices should start and stop. In this way, the musical composition may be stored and transmitted in a compact file format according to the MIDI format.

MIDI is supported in a wide variety of devices. For example, wireless communication devices, such as radiotelephones, may support MIDI files for downloadable sounds such as ringtones or other audio output. Digital music players, such as the "iPod" devices sold by Apple Computer, Inc and the "Zune" devices sold by Microsoft Corporation may also support MIDI file formats. Other devices that support the MIDI format may include various music synthesizers, wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, various computerized toys for children, on-board computers used in automobiles, watercraft and aircraft, and a wide variety of other devices.

SUMMARY

In general, this disclosure describes techniques for processing audio files that comply with the musical instrument digital interface (MIDI) format. As used herein, the term MIDI file refers to any file that contains at least one audio track that conforms to a MIDI format. According to this disclosure, techniques are described for efficient processing of MIDI files using software, firmware and hardware. In particular, various tasks associated with MIDI file processing are delegated between software operating on a general purpose processor, firmware associated with a digital signal processor (DSP), and dedicated hardware that is specifically designed for MIDI file processing. Alternatively, the tasks associated with MIDI file processing can be delegated between two different threads of a DSP and the dedicated hardware.

The described techniques can be pipelined for improved efficiency in the processing of MIDI files. A general purpose processor may service MIDI files for a first frame (frame N). When the first frame (frame N) is serviced by the DSP, a second frame (frame N+1) can be simultaneously serviced by the general purpose processor. When the first frame (frame N) is serviced by the hardware, the second frame (frame N+1) can be simultaneously serviced by the DSP while a third frame (frame N+2) is serviced by the general purpose processor. Similar pipelining may also be used if the tasks associated with MIDI file processing are delegated between two different threads of a DSP and the dedicated hardware.

In either case, MIDI file processing is separated into pipelined stages that can be processed at the same time, improving efficiency and possibly reducing the computational resources needed for given stages, such as those associated with the DSP. Each frame passes through the various pipeline stages, from the general purpose processor, to the DSP, and then to the hardware, or from a first DSP thread to a second DSP thread, and then to the hardware. Audio samples generated by the hardware may be delivered back to the DSP, e.g., via interrupt-driven techniques, so that any post-processing can be performed prior to output of audio sounds to a user.

In one aspect, this disclosure provides a method comprising parsing MIDI files and scheduling MIDI events associated with the MIDI files using a first process, processing the MIDI events using a second process to generate MIDI synthesis parameters, and generating audio samples using a hardware unit based on the synthesis parameters.

In another aspect, this disclosure provides a device comprising a processor that executes software to parse MIDI files and schedule MIDI events associated with the MIDI files, a DSP that processes the MIDI events and generates MIDI synthesis parameters, and a hardware unit that generates audio samples based on the synthesis parameters.

In another aspect, this disclosure provides a device comprising software means for parsing MIDI files and scheduling MIDI events associated with the MIDI files, firmware means for processing the MIDI events to generate MIDI synthesis parameters, and hardware means for generating audio samples based on the synthesis parameters.

In another aspect, this disclosure provides a device comprising a multi-threaded DSP including a first thread that parses MIDI files and schedule MIDI events associated with the MIDI files, and a second thread that processes the MIDI events and generates MIDI synthesis parameters, and a hardware unit that generates audio samples based on the synthesis parameters.

In another aspect, this disclosure provides a computer-readable medium comprising instructions that upon execution by one or more processors, cause the one or more processors to parse MIDI files and schedule MIDI events associated with the MIDI files using a first process, process the MIDI events using a second process to generate MIDI synthesis parameters, and generate audio samples using a hardware unit based on the synthesis parameters.

In another aspect, this disclosure provides a circuit configured to parse MIDI files and schedule MIDI events associated with the MIDI files using a first process, process the MIDI events using a second process to generate MIDI synthesis parameters, and generate audio samples using a hardware unit based on the synthesis parameters.

The details of one or more aspects of this disclosure are set forth in the accompanying drawings and the description below. Other features, objects, and advantages will be apparent from the description and drawings, and from the claims.

DETAILED DESCRIPTION

Figure 1:
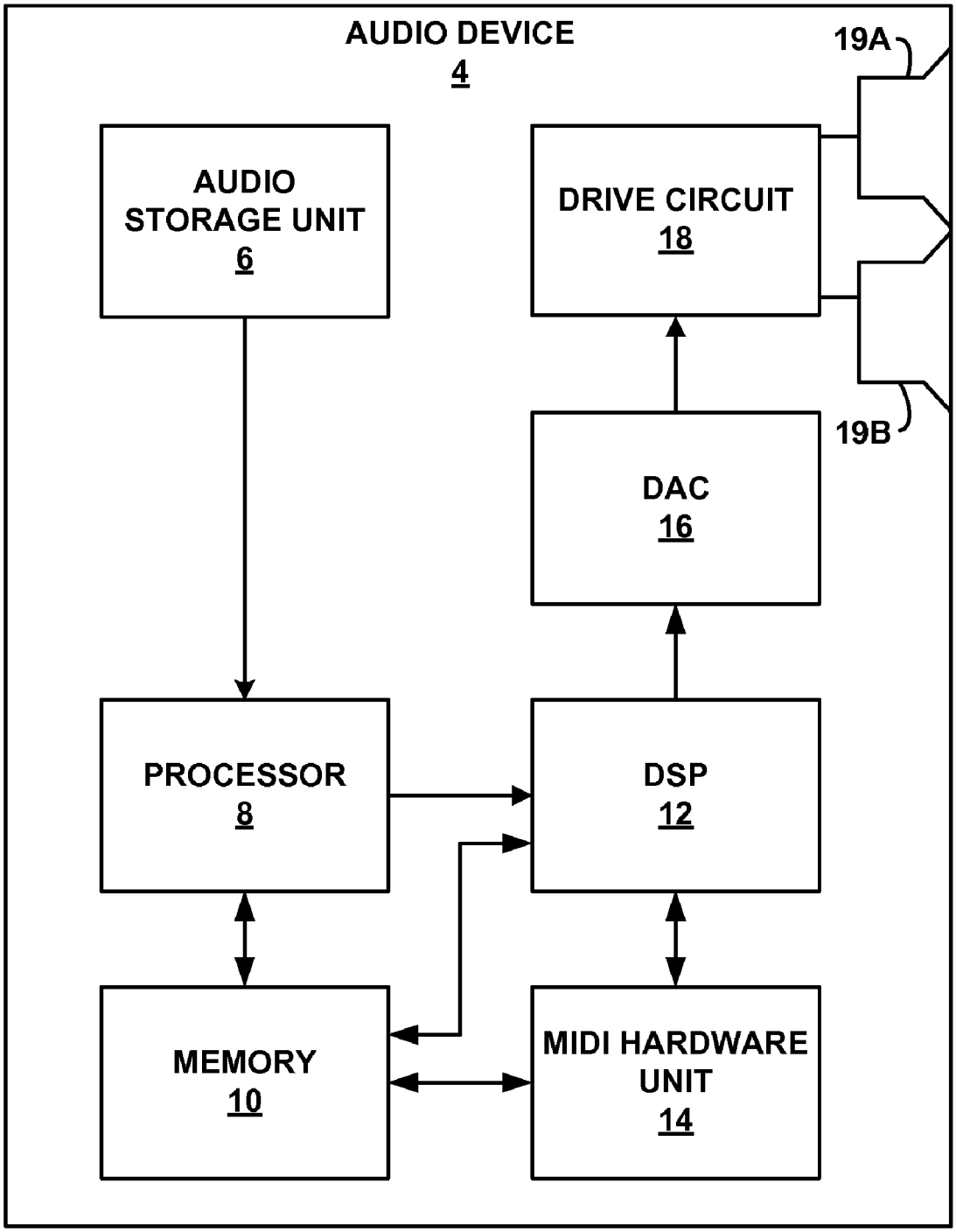
FIG. 1 is a block diagram illustrating an exemplary audio device that may implement the techniques of this disclosure.

This disclosure describes techniques for processing audio files that comply with a musical instrument digital interface (MIDI) format. As used herein, the term MIDI file refers to any file that contains at least one track that conforms to a MIDI format. Examples of various file formats that may include MIDI tracks include CMX, SMAF, XMF, SP-MIDI to name a few. CMX stands for Compact Media Extensions, developed by Qualcomm Inc. SMAF stands for the Synthetic Music Mobile Application Format, developed by Yamaha Corp. XMF stands for eXtensible Music Format, and SP-MIDI stands for Scalable Polyphony MIDI.

As described in greater detail below, this disclosure provides techniques in which various tasks associated with a MIDI file processing are delegated between software operating on a general purpose processor, firmware associated with a digital signal processor (DSP), and dedicated hardware that is specifically designed for MIDI file processing. The described techniques can be pipelined for improved efficiency in the processing of MIDI files.

A general purpose processor may execute software to parse MIDI files and schedule MIDI events associated with the MIDI files. The scheduled events can then be serviced by a DSP in a synchronized manner, as specified by timing parameters in the MIDI files. The general purpose processor dispatches the MIDI events to the DSP in a time-synchronized manner, and the DSP processes the MIDI events according to the time-synchronized schedule in order to generate MIDI synthesis parameters. The DSP then schedules processing of the synthesis parameters in hardware, and a hardware unit can generates audio samples based on the synthesis parameters.

The general purpose processor may service MIDI files for a first frame (frame N), and when the first frame (frame N) is serviced by the DSP, a second frame (frame N+1) can be simultaneously serviced by the general purpose processor. Furthermore, when the first frame (frame N) is serviced by the hardware, the second frame (frame N+1) is simultaneously serviced by the DSP while a third frame (frame N+2) is serviced by the general purpose processor. In this way, MIDI file processing is separated into pipelined stages that can be processed at the same time, which can improve efficiency and possibly reduce the computational resources needed for given stages, such as those associated with the DSP. Each frame passes through the various pipeline stages, from the general purpose processor, to the DSP, and then to the hardware. In some cases, audio samples generated by the hardware may be delivered back to the DSP, e.g., via interrupt-driven techniques, so that any post-processing can be performed. Audio samples may then be converted into analog signals, which can be used to drive speakers and output audio sounds to a user.

Alternatively, the tasks associated with MIDI file processing can be delegated between two different threads of a DSP and the dedicated hardware. That is to say, the tasks associated with the general purpose processor (as described herein) could alternatively be executed by a first thread of a multi-threaded DSP. In this case, the first thread of the DSP executes the scheduling, a second thread of the DSP generates the synthesis parameters, and the hardware unit generates audio samples based on the synthesis parameters. This alternative example may also be pipelined in a manner similar to the example that uses a general purpose processor for the scheduling.

FIG. 1 is a block diagram illustrating an exemplary audio device 4. Audio device 4 may comprise any device capable of processing MIDI files, e.g., files that include at least one MIDI track. Examples of audio device 4 include a wireless communication device such as a radiotelephone, a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, a circuit board installed in a device, a kiosk device, a video game console, various computerized toys for children, an on-board computer used in an automobile, watercraft or aircraft, or a wide variety of other devices.

The various components illustrated in FIG. 1 are provided to explain aspects of this disclosure. However, other components may exist and some of the illustrated components may not be included in some implementations. For example, if audio device 4 is a radiotelephone, then an antenna, transmitter, receiver and modem (modulator-demodulator) may be included to facilitate wireless communication of audio files.

As illustrated in the example of FIG. 1, audio device 4 includes an audio storage unit 6 to store MIDI files. Again, MIDI files generally refer to any audio file that includes at least one track coded in a MIDI format. Audio storage unit 6 may comprise any volatile or non-volatile memory or storage. For purposes of this disclosure, audio storage unit 6 can be viewed as a storage unit that forwards MIDI files to processor 8, or processor 8 retrieves MIDI files from audio storage unit 6, in order for the files to be processed. Of course, audio storage unit 6 could also be a storage unit associated with a digital music player or a temporary storage unit associated with information transfer from another device. Audio storage unit 6 may be a separate volatile memory chip or non-volatile storage device coupled to processor 8 via a data bus or other connection. A memory or storage device controller (not shown) may be included to facilitate the transfer of information from audio storage unit 6.

In accordance with this disclosure, device 4 implements an architecture that separates MIDI processing tasks between software, hardware and firmware. In particular, device 4 includes a processor 8, a DSP 12 and a MIDI hardware unit 14. Each of these components may be coupled to a memory unit 10, e.g., directly or via a bus. Processor 8 may comprise a general purpose processor that executes software to parse MIDI files and schedule MIDI events associated with the MIDI files. The scheduled events can be dispatched to DSP 12 in a time-synchronized manner and thereby serviced by DSP 12 in a synchronized manner, as specified by timing parameters in the MIDI files. DSP 12 processes the MIDI events according to the time-synchronized schedule created by general purpose processor 8 in order to generate MIDI synthesis parameters. DSP 12 may also schedule subsequent processing of the MIDI synthesis parameters by MIDI hardware unit 14. MIDI hardware unit 14 generates audio samples based on the synthesis parameters.

Processor 8 may comprise any of a wide variety of general purpose single- or multi-chip microprocessors. Processor 8 may implement a CISC (Complex instruction Set Computer) design or a RISC (Reduced Instruction Set Computer) design. Generally, processor 8 comprises a central processing unit (CPU) that executes software. Examples include 16-bit, 32-bit or 64-bit microprocessors from companies such as Intel Corporation, Apple Computer, Inc, Sun Microsystems Inc., Advanced Micro Devices (AMD) Inc., and the like. Other examples include Unix- or Linux-based microprocessors from companies such as International Business Machines (IBM) Corporation, RedHat Inc., and the like. The general purpose processor may comprise the ARM9, which is commercially available from ARM Inc., and the DSP may comprise the QDSP4 DSP developed by Qualcomm Inc.

Processor 8 may service MIDI files for a first frame (frame N), and when the first frame (frame N) is serviced by DSP 12, a second frame (frame N+1) can be simultaneously serviced by processor 8. When the first frame (frame N) is serviced by MIDI hardware unit 14, the second frame (frame N+1) is simultaneously serviced by DSP 12 while a third frame (frame N+2) is serviced by processor 8. In this way, MIDI file processing is separated into pipelined stages that can be processed at the same time, which can improve efficiency and possibly reduce the computational resources needed for given stages. DSP 12, for example, may be simplified relative to conventional DSPs that execute a full MIDI algorithm without the aid of a processor 8 or MIDI hardware 14.

In some cases, audio samples generated by MIDI hardware 14 are delivered back to DSP 12, e.g., via interrupt-driven techniques. In this case, DSP may also perform post-processing techniques on the audio samples. DAC 16 converts the audio samples, which are digital, into analog signals that can be used by drive circuit 18 to drive speakers 19A and 19B for output of audio sounds to a user.

For each audio frame, processor 8 reads one or more MIDI files and may extract MIDI instructions from the MIDI file. Based on these MIDI instructions, processor 8 schedules MIDI events for processing by DSP 12, and dispatches the MIDI events to DSP 12 according to this scheduling. In particular, this scheduling by processor 8 may include synchronization of timing associated with MIDI events, which can be identified based on timing parameters specified in the MIDI files. MIDI instructions in the MIDI files may instruct a particular MIDI voice to start or stop. Other MIDI instructions may relate to aftertouch effects, breath control effects, program changes, pitch bend effects, control messages such as pan left or right, sustain pedal effects, main volume control, system messages such as timing parameters, MIDI control messages such as lighting effect cues, and/or other sound affects. After scheduling MIDI events, processor 8 may provide the scheduling to memory 10 or DSP 12 so that DSP 12 can process the events. Alternatively, processor 8 may execute the scheduling by dispatching the MIDI events to DSP 12 in the time-synchronized manner.

Memory 10 may be structured such that processor 8, DSP 12 and MIDI hardware 14 can access any information needed to perform the various tasks delegated to these different components. In some cases, the storage layout of MIDI information in memory 10 may be arranged to allow for efficient access from the different components 8, 12 and 14.

When DSP 12 receives scheduled MIDI events from processor 8 (or from memory 10), DSP 12 may process the MIDI events in order to generate MIDI synthesis parameters, which may be stored back in memory 10. Again, the timing in which these MIDI events are serviced by DSP is scheduled by processor 8, which creates efficiency by eliminating the need for DSP 12 to perform such scheduling tasks. Accordingly, DSP 12 can service the MIDI events for a first audio frame while processor 8 is scheduling MIDI events for the next audio frame. Audio frames may comprise blocks of time, e.g., 10 millisecond (ms) intervals, that may include several audio samples. The digital output, for example, may result in 480 samples per frame, which can be converted into an analog audio signal. Many events may correspond to one instance of time so that many notes or sounds can be included in one instance of time according to the MIDI format. Of course, the amount of time delegated to any audio frame, as well as the number of samples per frame may vary in different implementations.

Once DSP 12 has generated the MIDI synthesis parameters, MIDI hardware unit 14 generates audio samples based on the synthesis parameters. DSP 12 can schedule the processing of the MIDI synthesis parameters by MIDI hardware unit 14. The audio samples generated by MIDI hardware unit 14 may comprise pulse-code modulation (PCM) samples, which are digital representations of an analog signal that is sampled at regular intervals. Additional details of exemplary audio generation by MIDI hardware unit 14 are discussed below with reference to FIG. 3.

In some cases, post processing may need to be performed on the audio samples. In this case, MIDI hardware unit 14 can send an interrupt command to DSP 12 to instruct DSP 12 to perform such post processing. The post processing may include filtering, scaling, volume adjustment, or a wide variety of audio post processing that may ultimately enhance the sound output.

Following the post processing, DSP 12 may output the post processed audio samples to digital-to analog converter (DAC) 16. DAC 16 converts the digital audio signals into an analog signal and outputs the analog signal to a drive circuit 18. Drive circuit 18 may amplify the signal to drive one or more speakers 19A and 19B to create audible sound.

Figure 2:
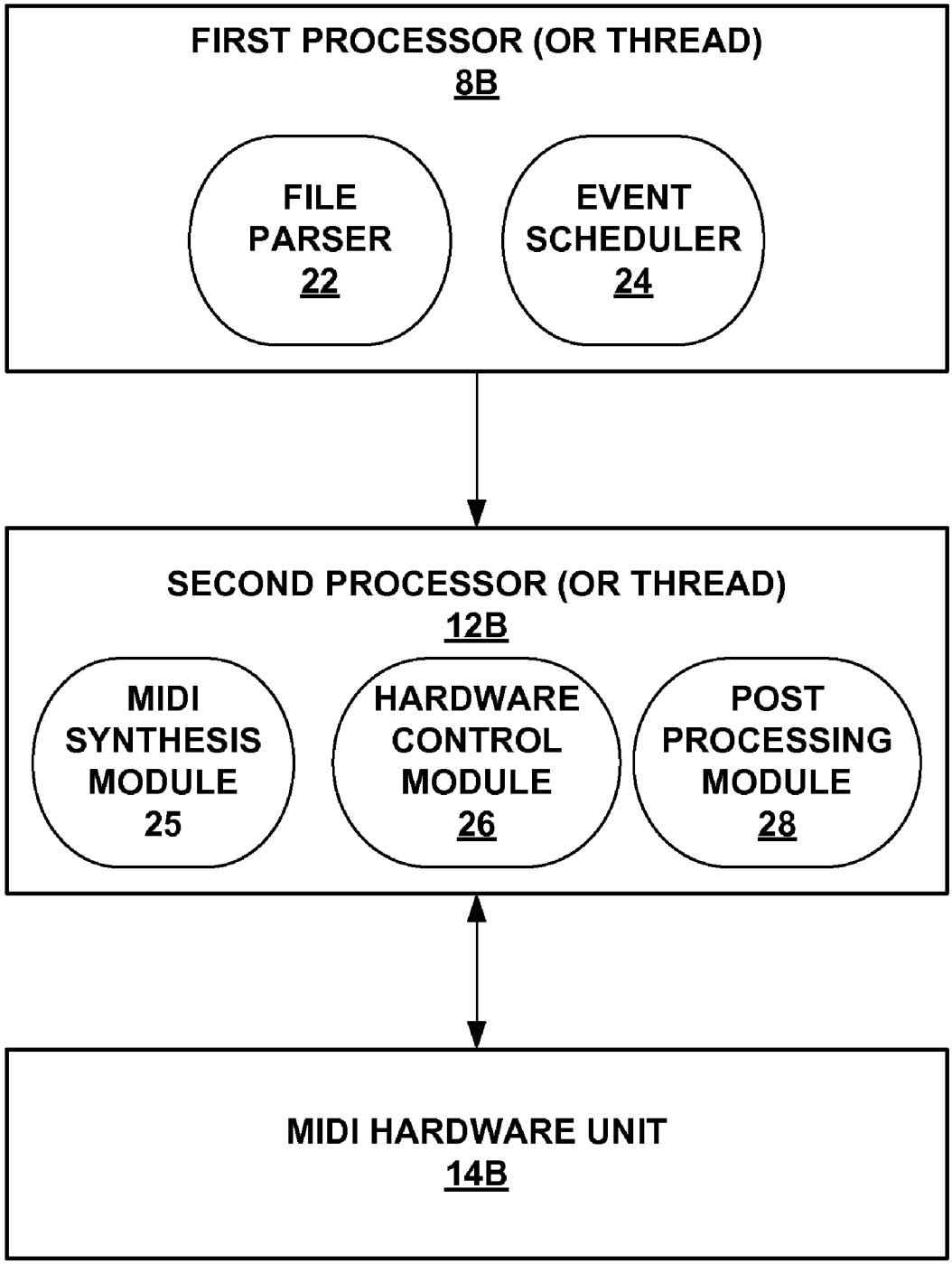
FIG. 2 is a block diagram illustrating a first processor (or first thread), a second processor (or second thread) and musical instrument digital interface (MIDI) hardware, which can be pipelined for efficient processing of MIDI files.

FIG. 2 is a block diagram illustrating a first processor (or first thread) 8B, a second processor (or second thread) 12B and a MIDI hardware unit 14B, which can be pipelined for efficient processing of MIDI files. Processors (or threads) 8B 12B and MIDI hardware unit 14B may correspond to processor 8, DSP 12 and unit 14 of FIG. 1. Alternatively elements 8B and 12B may correspond to two different processing threads (different processes) executed in a multi-threaded DSP. In this case, the first thread of the DSP executes the scheduling, a second thread of the DSP generates the synthesis parameters, and the hardware unit generates audio samples based on the synthesis parameters. This alternative example may also be pipelined in a manner similar to the example that uses a general purpose processor for the scheduling.

As shown in FIG. 2, first processor (or thread) 8B executes a file parser module 22 and an event scheduler module 24. File parser module 22 parses MIDI files to identify the MIDI events in the MIDI files that need to be scheduled. In other words, file parser examines the MIDI files to identify timing parameters indicative of MIDI events that need scheduling. Event scheduler module 24 then schedules the events for servicing by second processor (or thread) 12B. First processor (or thread) 8B dispatches the scheduled MIDI events to second processor (or thread) 12B in a time-synchronized manner, as defined by event scheduler module 24.

Second processor (or thread) 12B includes a MIDI synthesis module 25, a hardware control module 26 and a post processing module 28. MIDI synthesis module 25 comprises executable instructions that cause second processor (or thread) 12B to generate synthesis parameters based on MIDI events. First processor (or thread) 8B schedules the MIDI events, however, so that this scheduling task does not slow the synthesis parameter generation by second processor (or thread) 12B.

Hardware control module 26 is the software control executed by second processor (or thread) 12B for controlling the operation of MIDI hardware unit 14. Hardware control module 26 may issue commands to MIDI hardware unit 14 and may schedule the servicing of synthesis parameters by MIDI hardware unit 14. Post processing module 28 is a software module executed by second processor (or thread) 12B to perform any post processing on audio samples generated by MIDI hardware unit 14B.

Once second processor (or thread) 12B has generated the synthesis parameters, MIDI hardware unit 14B uses these synthesis parameters to create audio samples, which can be post processed and then used to drive speakers. Further details of one implementation of a specific MIDI hardware unit 14C are discussed below with reference to FIG. 3. However, other MIDI hardware implementations could also be defined consistent with the teaching of this disclosure. For example, although MIDI hardware unit 14C shown in FIG. 3 uses a wave table-based approach to voice synthesis, other approaches including frequency modulation synthesis approaches could also be used.

Importantly, the components shown in FIG. 2, i.e., first processor (or thread) 8B, second processor (or thread) 12B and MIDI hardware unit 14B, function in a pipelined manner. Specifically, audio frames pass along this processing pipeline such that when a first frame (e.g., frame N) is being serviced by hardware unit 14B, a second frame (e.g., frame N+1) is being serviced by second processor (or thread) 12B and a third frame (e.g., frame N+2) is being serviced by first processor (or thread) 8B. Such pipelined processing of MIDI files using a general purpose processor, a DSP and a MIDI hardware unit (or alternatively a first DSP thread, a second DSP thread, and a MIDI hardware unit) in a three-stage implementation can provide efficiency in the processing of audio frames that include MIDI files.

Figure 3:
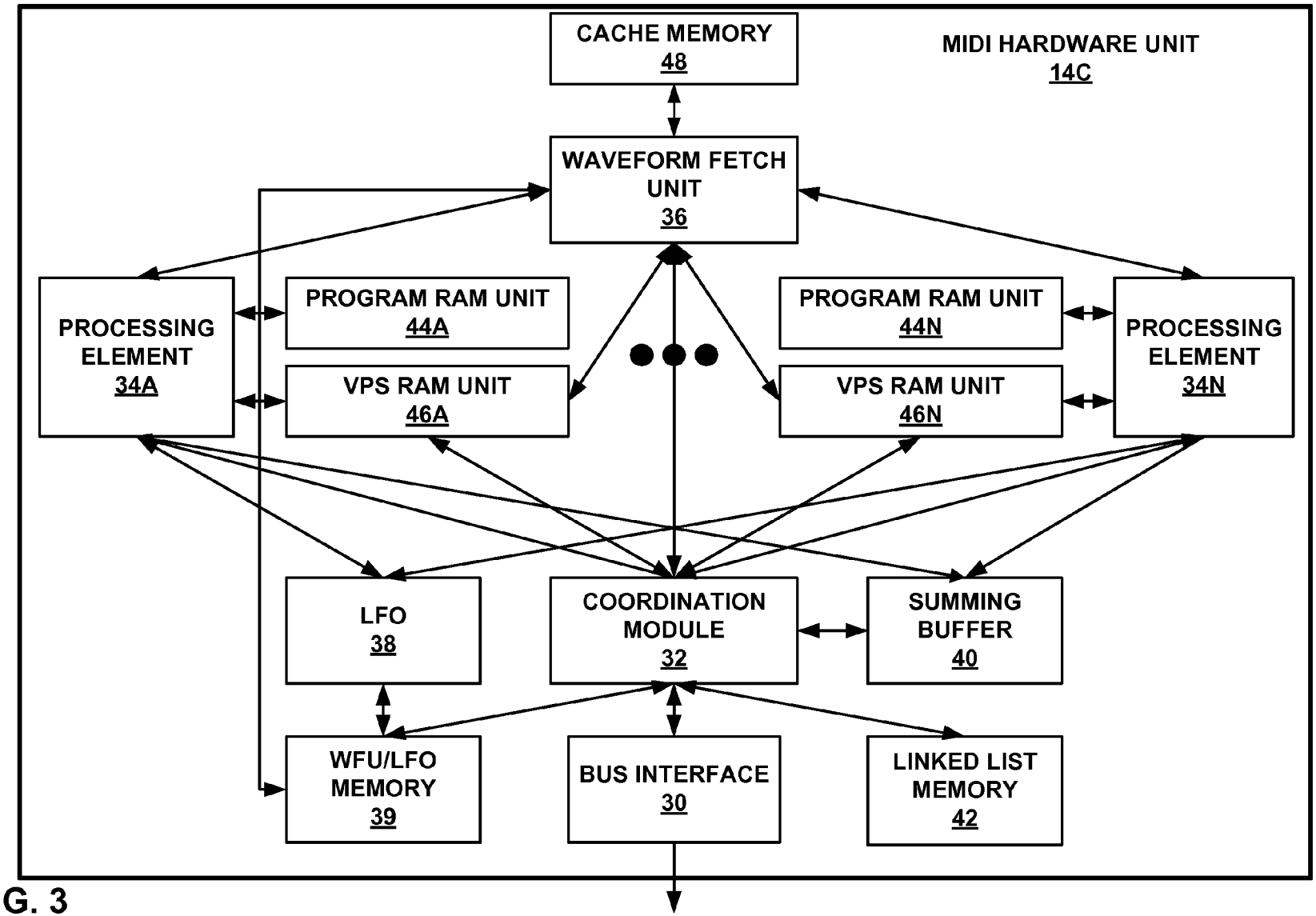
FIG. 3 is a more detailed block diagram of one example of MIDI hardware.

FIG. 3 is a block diagram illustrating an exemplary MIDI hardware unit 14C, which may correspond to audio hardware unit 14 of audio device 4. The implementation shown in FIG. 3 is merely exemplary as other hardware implementations could also be defined consistent with the teaching of this disclosure. As illustrated in the example of FIG. 3, MIDI hardware unit 14C includes a bus interface 30 to send and receive data. For example, bus interface 30 may include an AMBA High-performance Bus (AHB) master interface, an AHB slave interface, and a memory bus interface. AMBA stands for advanced microprocessor bus architecture. Alternatively, bus interface 30 may include an AXI bus interface, or another type of bus interface. AXI stands for advanced extensible interface.

In addition, MIDI hardware unit 14C may include a coordination module 32. Coordination module 32 coordinates data flows within MIDI hardware unit 14C. When MIDI hardware unit 14C receives an instruction from DSP 12 (FIG. 1) to begin synthesizing an audio sample, coordination module 32 reads the synthesis parameters for the audio frame from memory 10, which were generated by DSP 12 (FIG. 1). These synthesis parameters can be used to reconstruct the audio frame. For the MIDI format, synthesis parameters describe various sonic characteristics of one or more MIDI voices within a given frame. For example, a set of MIDI synthesis parameters may specify a level of resonance, reverberation, volume, and/or other characteristics that can affect one or more voices.

At the direction of coordination module 32, synthesis parameters may be loaded from memory 10 (FIG. 1) into voice parameter set (VPS) RAM 46A or 46N associated with a respective processing element 34A or 34N. At the direction of DSP 12 (FIG. 1), program instructions are loaded from memory 10 into program RAM units 44A or 44N associated with a respective processing element 34A or 34N.

The instructions loaded into program RAM unit 44A or 44N instruct the associated processing element 34A or 34N to synthesize one of the voices indicated in the list of synthesis parameters in VPS RAM unit 46A or 46N. There may be any number of processing elements 34A-34N (collectively "processing elements 34"), and each may comprise one or more ALUs that are capable of performing mathematical operations, as well as one or more units for reading and writing data. Only two processing elements 34A and 34N are illustrated for simplicity, but many more may be included in MIDI hardware unit 14C. Processing elements 34 may synthesize voices in parallel with one another. In particular, the plurality of different processing elements 34 work in parallel to process different synthesis parameters. In this manner, a plurality of processing elements 34 within MIDI hardware unit 14C can accelerate and possibly improve the generation of audio samples.

When coordination module 32 instructs one of processing elements 34 to synthesize a voice, the respective processing element may execute one or more instructions associated with the synthesis parameters. Again, these instructions may be loaded into program RAM unit 44A or 44N. The instructions loaded into program RAM unit 44A or 44N cause the respective one of processing elements 34 to perform voice synthesis. For example, processing elements 34 may send requests to a waveform fetch unit (WFU) 36 for a waveform specified in the synthesis parameters. Each of processing elements 34 may use WFU 36. An arbitration scheme may be used to resolve any conflicts if two or more processing elements 34 request use of WFU 36 at the same time.

In response to a request from one of processing elements 34, WFU 36 returns one or more waveform samples to the requesting processing element. However, because a wave can be phase shifted within a sample, e.g., by up to one cycle of the wave, WFU 36 may return two samples in order to compensate for the phase shifting using interpolation. Furthermore, because a stereo signal may include two separate waves for the two stereophonic channels, WFU 36 may return separate samples for different channels, e.g., resulting in up to four separate samples for stereo output.

After WFU 36 returns audio samples to one of processing elements 34, the respective processing element may execute additional program instructions based on the synthesis parameters. In particular, instructions cause one of processing elements 34 to request an asymmetric triangular wave from a low frequency oscillator (LFO) 38 in MIDI hardware unit 14C. By multiplying a waveform returned by WFU 36 with a triangular wave returned by LFO 38, the respective processing element may manipulate various sonic characteristics of the waveform to achieve a desired audio affect. For example, multiplying a waveform by a triangular wave may result in a waveform that sounds more like a desired musical instrument.

Other instructions executed based on the synthesis parameters may cause a respective one of processing elements 34 to loop the waveform a specific number of times, adjust the amplitude of the waveform, add reverberation, add a vibrato effect, or cause other effects. In this way, processing elements 34 can calculate a waveform for a voice that lasts one MIDI frame. Eventually, a respective processing element may encounter an exit instruction. When one of processing elements 34 encounters an exit instruction, that processing element signals the end of voice synthesis to coordination module 32. The calculated voice waveform can then be provided to summing buffer 40, at the direction of another store instruction that causes summing buffer 40 to store that calculated voice waveform. The calculated voice waveform can be provided to summing buffer 40 at the direction of another store instruction during the execution of the program instructions. This causes summing buffer 40 to store that calculated voice waveform.

When summing buffer 40 receives a calculated waveform from one of processing elements 34, summing buffer 40 adds the calculated waveform to the proper instance of time associated with an overall waveform for a MIDI frame. Thus, summing buffer 40 combines output of the plurality of processing elements 34. For example, summing buffer 40 may initially store a flat wave (i.e., a wave where all digital samples are zero.) When summing buffer 40 receives audio information such as a calculated waveform from one of processing elements 34, summing buffer 40 can add each digital sample of the calculated waveform to respective samples of the waveform stored in summing buffer 40. In this way, summing buffer 40 accumulates and stores an overall digital representation of a waveform for a full audio frame.

Summing buffer 40 essentially sums different audio information from different ones of processing elements 34. The different audio information is indicative of different instances of time associated with different generated voices. In this manner, summing buffer 40 creates audio samples representative of an overall audio compilation within a given audio frame.

Processing elements 34 may operate in parallel with one another, yet independently. That is to say, each of processing elements 34 may process a synthesis parameter, and then move on to the next synthesis parameter once the audio information generated for the first synthesis parameter is added to summing buffer 40. Thus, each of processing elements 34 performs its processing tasks for one synthesis parameter independently of the other processing elements 34, and when the processing for synthesis parameter is complete that respective processing element becomes immediately available for subsequent processing of another synthesis parameter.

Eventually, coordination module 32 may determine that processing elements 34 have completed synthesizing all of the voices required for the current audio frame and have provided those voices to summing buffer 40. At this point, summing buffer 40 contains digital samples indicative of a completed waveform for the current audio frame. When coordination module 32 makes this determination, coordination module 32 sends an interrupt to DSP 12 (FIG. 1). In response to the interrupt, DSP 12 may send a request to a control unit in summing buffer 40 (not shown) via direct memory exchange (DME) to receive the content of summing buffer 40. Alternatively, DSP 12 may also be pre-programmed to perform the DME. DSP 12 may then perform any post processing on the digital audio samples, before providing the digital audio samples to DAC 16 for conversion into the analog domain. In accordance with this disclosure, the processing performed by MIDI hardware unit 14C with respect to a frame N+2 occurs simultaneously with synthesis parameter generation by DSP 12 (FIG. 1) respect to a frame N+1, and scheduling operations by processor 8 (FIG. 1) respect to a frame N.

Cache memory 48, WFU/LFO memory 39 and linked list memory 42 are also shown in FIG. 3. Cache memory 48 may be used by WFU 36 to fetch base waveforms in a quick and efficient manner. WFU/LFO memory 39 may be used by coordination module 32 to store voice parameters of the voice parameter set. In this way, WFU/LFO memory 39 can be viewed as memories dedicated to the operation of waveform fetch unit 36 and LFO 38. Linked list memory 42 may comprise a memory used to store a list of voice indicators generated by DSP 12. The voice indicators may comprise pointers to one or more synthesis parameters stored in memory 10. Each voice indicator in the list may specify the memory location that stores a voice parameter set for a respective MIDI voice. The various memories and arrangements of memories shown in FIG. 3 are purely exemplary. The techniques described herein could be implemented with a variety of other memory arrangements.

In accordance with this disclosure, any number of processing elements 34 may be included in MIDI hardware unit 14C provided that a plurality of processing elements 34 operate simultaneously with respect to different synthesis parameters stored in memory 10 (FIG. 1). A first audio processing element 34A, for example, processes a first audio synthesis parameter to generate first audio information while another audio processing element 34N processes a second audio synthesis parameter to generate second audio information. Summing buffer 40 can then combine the first and second audio information in the creation of one or more audio samples. Similarly, a third audio processing element (not shown) and a fourth processing element (not shown) may process third and fourth synthesis parameters to generate third and fourth audio information, which can also be accumulated in summing buffer 40 in the creation of the audio samples.

Processing elements 34 may process all of the synthesis parameters for an audio frame. After processing each respective synthesis parameter, the respective one of processing elements 34 adds its processed audio information in to the accumulation in summing buffer 40, and then moves on to the next synthesis parameter. In this way, processing elements 34 work collectively to process all of the synthesis parameters generated for one or more audio files of an audio frame. Then, after the audio frame is processed and the samples in summing buffer are sent to DSP 12 for post processing, processing elements 34 can begin processing the synthesis parameters for the audio files of the next audio frame.

Again, first audio processing element 34A processes a first audio synthesis parameter to generate first audio information while a second audio processing element 34N processes a second audio synthesis parameter to generate second audio information. At this point, first processing element 34A may process a third audio synthesis parameter to generate third audio information while a second audio processing element 34N processes a fourth audio synthesis parameter to generate fourth audio information. Summing buffer 40 can combine the first, second, third and fourth audio information in the creation of one or more audio samples.

Figure 4:
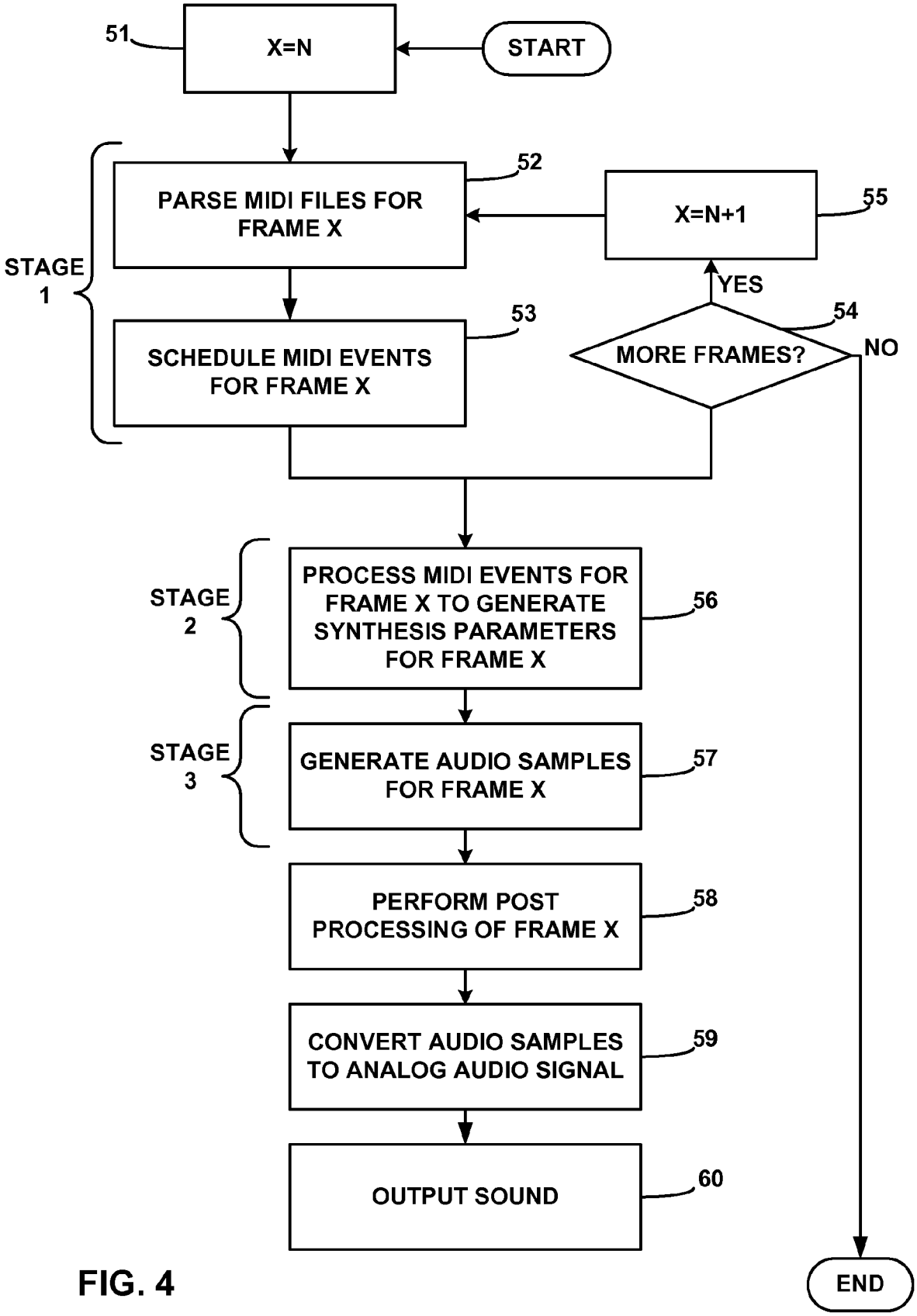
FIG. 4 is a flow diagram illustrating an exemplary technique consistent with the teaching of this disclosure.

FIG. 4 is a flow diagram illustrating an exemplary technique consistent with the teaching of this disclosure. FIG. 4 will be described with reference to device 4 of FIG. 1 although other devices could implement the techniques of FIG. 4. Stages 1 and 2, labeled in FIG. 4 could alternatively be executed by two different threads of a multi-threaded DSP.

As shown in FIG. 4, beginning with a first audio frame N (51), software executing on processor 8 parses MIDI files (52), and schedules MIDI events (53). The scheduled events may be stored with the schedule or dispatched to DSP 12 in accordance with the scheduling. In any case, DSP 12 processes the MIDI events for frame N to generate synthesis parameters (56).

At this point, while DSP 12 is processing the MIDI events for frame N (56), if there are more frames in the audio sequence (yes branch of 54), software executing on processor 8 begins servicing the next frame (55), i.e., frame N+1. Thus, while DSP 12 is processing the MIDI events for frame N (56), software executing on processor 8 parses MIDI files for frame N+1 (52), and schedules MIDI events for frame N+1 (53). In other words, stages 1 and 2 are performed simultaneously with respect to frame N and frame N+1.

Next, MIDI hardware unit 14 generates audio samples for frame N (57). At this point, DSP is processing the MIDI events for frame N+1 (56), and software executing on processor 8 is parsing MIDI files for frame N+2 (52) and scheduling MIDI events for frame N+2 (53). In other words, stages 1, 2 and 3 are performed simultaneously with respect to frame N, frame N+1 and frame N+2. This staged approach continues for each subsequent audio frame such that the audio frames pass through stages 1, 2 and 3 in a pipelined fashion. When frame N+1 is serviced by hardware unit 14, frame N+2 is serviced by DSP 12 and frame N+3 is serviced by general purpose processor 8. When frame N+2 is serviced by hardware unit 14, frame N+3 is serviced by DSP 12 and frame N+4 is serviced by general purpose processor 8, and so forth.

Once audio samples are generated for any given frame (57), post processing may be performed on that frame (58). DSP 12 may execute any post processing in response to an interrupt command from hardware unit 14. In this manner, DSP 12 handles not only the processing of MIDI events, but also any post processing that need to be performed on the generated audio frames.

Following the post processing for any frame (58), DAC 16 converts audio samples for the frame to an analog audio signal (59), which can be provided to drive circuit 18. Drive circuit 18 uses the analog audio signal to create drive signals that cause speakers 19A and 19B to output sound (60).

Various examples have been described. One or more aspects of the techniques described herein may be implemented in hardware, software, firmware, or combinations thereof. Any features described as modules or components may be implemented together in an integrated logic device or separately as discrete but interoperable logic devices. If implemented in software, one or more aspects of the techniques may be realized at least in part by a computer-readable medium comprising instructions that, when executed, performs one or more of the methods described above. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, one or more aspects of this disclosure may be directed to a circuit, such as an integrated circuit, chipset, ASIC, FPGA, logic, or various combinations thereof configured or adapted to perform one or more of the techniques described herein. The circuit may include both the processor and one or more hardware units, as described herein, in an integrated circuit or chipset.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

Various aspects and examples have been described. However, modifications can be made to the structure or techniques of this disclosure without departing from the scope of the following claims. For example, other types of devices could also implement the MIDI processing techniques described herein. Also, although the exemplary hardware unit 14C, shown in FIG. 3 uses a wave-table based approach to voice synthesis, other approaches including frequency modulation synthesis approaches could also be used. These and other embodiments are within the scope of the following claims.

The invention claimed is:

1. A method comprising:

parsing musical instrument digital interface (MIDI) files and scheduling MIDI events associated with the MIDI files using a first process, wherein the first process is executed by a processor, and wherein scheduling the MIDI events includes synchronizing timing of the MIDI events based on timing parameters specified in the MIDI files;

processing the MIDI events using a second process to generate MIDI synthesis parameters, wherein the second process is executed by a digital signal processor (DSP), and wherein the first process dispatches the MIDI events to the second process in a time-synchronized manner; and generating audio samples using a hardware unit based on the synthesis parameters, wherein the hardware unit includes a first processing element and a second processing element, and wherein the first and second processing elements operate in parallel to process different ones of the MIDI synthesis parameters, wherein the processor, the DSP and the hardware unit operate in a pipelined manner, wherein in parallel:

the processor parses MIDI files and schedules MIDI events for an $(N+2)^{th}$ frame;

the DSP generates MIDI synthesis parameters for an $(N+1)^{th}$ frame; and the hardware unit generates audio samples for an $(N)^{th}$ frame.

2. The method of claim 1, wherein the audio samples comprise pulse coded modulation (PCM) samples.

3. The method of claim 1, wherein the audio samples comprise digital samples, the method further comprising:

converting the audio samples to an analog output; and outputting the analog output to a user.

4. The method of claim 1, wherein the MIDI files comprise files that contain at least one track that conforms to a MIDI format.

5. The method of claim 1, wherein the second process schedules processing of the synthesis parameters by the hardware unit.

6. The method of claim 1, further comprising post-processing the audio samples.

7. The method of claim 6, wherein the hardware unit issues interrupts to initiate the post-processing.

8. The method of claim 1, wherein the hardware unit includes a plurality of processing elements that work in parallel to process different synthesis parameters.

9. The method of claim 8, wherein the hardware unit further includes a summing buffer that combines output of the plurality of processing elements.

10. A device comprising:

a processor that executes software to parse musical instrument digital interface (MIDI) files and schedule MIDI events associated with the MIDI files, wherein the processor executes the software to synchronize timing of the MIDI events based on timing parameters specified in the MIDI files;

a digital signal processor (DSP) that processes the MIDI events and generates MIDI synthesis parameters, wherein the processor dispatches the MIDI events to the DSP in a time-synchronized manner; and a hardware unit that generates audio samples based on the synthesis parameters, wherein the hardware unit comprises a first processing element and a second processing element, and wherein the first and second processing elements operate in parallel to process different ones of the MIDI synthesis parameters, wherein the processor, the DSP and the hardware unit operate in a pipelined manner, wherein in parallel:

the processor parses MIDI files and schedules MIDI events for an $(N+2)^{th}$ frame;

the DSP generates MIDI synthesis parameters for an $(N+1)^{th}$ frame; and the hardware unit generates audio samples for an $(N)^{th}$ frame.

11. The device of claim 10, wherein the audio samples comprise pulse coded modulation (PCM) samples.

12. The device of claim 10, wherein the audio samples comprise digital audio samples, the device further comprising:

a digital-to-analog converter that converts the audio samples to an analog output;

a drive circuit that amplifies the analog output; and one or more speakers that output the amplified analog output to a user.

13. The device of claim 10, wherein the MIDI files comprise files that contain at least one track that conforms to a MIDI format.

14. The device of claim 10, wherein the DSP schedules processing of the synthesis parameters by the hardware unit.

15. The device of claim 10, wherein the DSP post-processes the audio samples.

16. The device of claim 15, wherein the hardware unit issues interrupts to the DSP to initiate the post-processing.

17. The device of claim 10, wherein the hardware unit includes a plurality of processing elements that work in parallel to process different synthesis parameters.

18. The device of claim 17, wherein the hardware unit further includes a summing buffer that combines output of the plurality of processing elements.

19. A device comprising:

software means for parsing musical instrument digital interface (MIDI) files and scheduling MIDI events associated with the MIDI files, wherein the software means synchronizes timing of the MIDI events based on timing parameters specified in the MIDI files;

firmware means for processing the MIDI events to generate MIDI synthesis parameters, wherein the software means dispatches the MIDI events to the firmware means in a time-synchronized manner; and hardware means for generating audio samples based on the synthesis parameters, wherein the hardware means includes a first processing element and a second processing element, and wherein the first and second processing elements operate in parallel to process different ones of the MIDI synthesis parameters, wherein the software means, the firmware means and the hardware means operate in a pipelined manner, wherein in parallel:

the software means parses MIDI files and schedules MIDI events for an $(N+2)^{th}$ frame;

the firmware means generates MIDI synthesis parameters for an $(N+1)^{th}$ frame; and the hardware means generates audio samples for an $(N)^{th}$ frame.

20. The device of claim 19, wherein the audio samples comprise pulse coded modulation (PCM) samples.

21. The device of claim 19, wherein the audio samples comprise digital audio samples, the device further comprising:

means for converting the audio samples to an analog output; and means for outputting the analog output to a user.

22. The device of claim 19, wherein the MIDI files comprise files that contain at least one track that conforms to a MIDI format.

23. The device of claim 19, wherein the firmware means schedules processing of the synthesis parameters by the hardware means.

24. The device of claim 19, wherein the firmware means post-processes the audio samples using the DSP.

25. The device of claim 24, wherein the hardware means issues interrupts to the firmware means to initiate the post-processing.

26. The device of claim 19, wherein the hardware means includes a plurality of processing elements that work in parallel to process different synthesis parameters.

27. The device of claim 26, wherein the hardware means further includes a summing buffer to combine output of the plurality of processing elements.

28. A device comprising:

a multi-threaded digital signal processor (DSP) including a first thread that parses musical instrument digital interface (MIDI) files and schedule MIDI events associated with the MIDI files, wherein the first thread synchronizes timing of the MIDI events based on timing parameters specified in the MIDI files, and a second thread that processes the MIDI events and generates MIDI synthesis parameters, wherein the first thread dispatches the MIDI events to the second in a time-synchronized manner; and a hardware unit that generates audio samples based on the synthesis parameters, wherein the hardware unit comprises a first processing element and a second processing element, and wherein the first and second processing elements overate in parallel to process different ones of the MIDI synthesis parameters, wherein the first thread, the second thread, and the hardware unit operate in a pipelined manner, wherein in parallel:

the first thread parses MIDI files and schedules MIDI events for an $(N+2)^{th}$ frame;

the second thread generates MIDI synthesis parameters for an $(N+1)^{th}$ frame; and the hardware unit generates audio samples for an $(N)^{th}$ frame.

29. A computer-readable medium comprising instructions that upon execution by one or more processors, cause the one or more processors to:

parse musical instrument digital interface (MIDI) files and schedule MIDI events associated with the MIDI files using a first process, wherein the first process is executed by a processor, and wherein scheduling the MIDI events includes synchronizing timing of the MIDI events based on timing parameters specified in the MIDI files;

process the MIDI events using a second process to generate MIDI synthesis parameters, wherein the second process is executed by a digital signal processor (DSP), and wherein the first process dispatches the MIDI events to the second process in a time-synchronized manner; and generate audio samples using a hardware unit based on the synthesis parameters, wherein the hardware unit includes a first processing element and a second processing element, and wherein the first and second processing elements operate in parallel to process different ones of the MIDI synthesis parameters, wherein the processor, the DSP and the hardware unit operate in a pipelined manner, wherein in parallel:

the first process parses MIDI files and schedules MIDI events for an $(N+2)^{th}$ frame;

the second process generates MIDI synthesis parameters for an $(N+1)^{th}$ frame; and the hardware unit generates audio samples for an $(N)^{th}$ frame.

30. A circuit configured to:

parse musical instrument digital interface (MIDI) files and schedule MIDI events associated with the MIDI files using a first process, wherein the first process is executed by a processor, and wherein the first process synchronizes timing of the MIDI events based on timing parameters specified in the MIDI files;

process the MIDI events using a second process to generate MIDI synthesis parameters, wherein the second process is executed by a digital signal processor (DSP), and wherein the first process dispatches the MIDI events to the second process in a time-synchronized manner; and generate audio samples using a hardware unit based on the synthesis parameters, wherein the hardware unit includes a first processing element and a second processing element, and wherein the first and second processing elements operate in parallel to process different ones of the MIDI synthesis parameters, wherein the processor, the DSP and the hardware unit operate in a pipelined manner, wherein in parallel:

the first process parses MIDI files and schedules MIDI events for an $(N+2)^{th}$ frame;

the second process generates MIDI synthesis parameters for an $(N+1)^{th}$ frame; and the hardware unit generates audio samples for an $(N)^{th}$ frame.

* * * * *